US005947449A

United States Patent [19]

Dubé et al.

[11] Patent Number: 5,947,449

[45] Date of Patent: Sep. 7, 1999

[54] APPARATUS FOR LIFTING OR SUPPORTING MODULAR FURNITURE

[76] Inventors: Jean-Guy Dubé, 1415 Beaver Pond Drive, Gloucester, Ontario, Canada, K1V 3X5; Kamal Roy Nandram, 1520 Orchard Avenue, Ottawa, Ontario, Canada, K1H 1A8

[21] Appl. No.: 09/034,267

[22] Filed: Mar. 4, 1998

[51] Int. Cl.[6] ..... B66F 3/00

[52] U.S. Cl. ..... 254/134; 254/108

[58] Field of Search ..... 254/108, 133 R, 254/89 R, 45

[56] References Cited

U.S. PATENT DOCUMENTS

| | | | |
|---|---|---|---|
| 599,026 | 2/1898 | Thomas | 254/108 |
| 5,261,643 | 11/1993 | Wurdack | 254/106 |
| 5,299,779 | 4/1994 | Collins | 254/1 |
| 5,385,335 | 1/1995 | Wurdack | 254/1 |
| 5,441,284 | 8/1995 | Mueller et al. . | |
| 5,490,757 | 2/1996 | Stratman | 414/680 |
| 5,529,287 | 6/1996 | Pelosi, Jr. et al. | 254/129 |
| 5,628,610 | 5/1997 | Stratman et al. | 414/680 |

FOREIGN PATENT DOCUMENTS

| | | | |
|---|---|---|---|
| 7-256505 | 10/1995 | Japan . | |
| 1305902 | 2/1973 | United Kingdom | 254/89 R |

*Primary Examiner*—David A. Scherbel
*Assistant Examiner*—Benjamin Halpern
*Attorney, Agent, or Firm*—Jones, Tullar & Cooper, PC

[57] ABSTRACT

Apparatus for lifting or supporting modular furniture to allow access to a floor for reflooring where the furniture has panels having accessory hanging tracks with apertures, including a support having a shaft which extending vertically, and a lifting jig which is movable on the shaft by a jack. The lifting jig comprises a lower portion having a support plate for engaging the underside of a panel, and an upper, stabilizer portion spaced above the support plate and having an undercut hook for engagement with one of the apertures of a hanging track so as to positively locate the jig in relation to the panel. The apparatus may also include a horizontal bridge extending between spaced feet, and a carrier slidable on the bridge and which may be used to support the lifting jig above a clear working space between its feet.

7 Claims, 7 Drawing Sheets

APPARATUS FOR LIFTING OR SUPPORTING MODULAR FURNITURE

BACKGROUND OF THE INVENTION.

1. Field of the Invention

The present invention relates to means for lifting or supporting modular furniture of the type used in offices, to allow access to an office floor, e.g. for replacement of carpets or other flooring, including panels of raised flooring, without the need to remove the furniture from the office.

2. Prior Art

Modern offices are often provided with so-called "modular furniture", which comprises an arrangement of panels interconnected at angles to form office dividers, and which have so-called "hanging tracks" used to support desks, bookshelves, and other necessary office equipment. These hanging tracks are vertical metal strips, usually located at the edges of the panels, having a series of undercut slots from which special hangers, with suitable hooks, can be suspended. Generally, these hanging tracks are aligned with feet which support the panels, and which usually provide the only contact between the floor and the modular furniture.

The fact that quite a number of such panels, and their associated desks and shelves, are connected together makes it time consuming and costly to dismantle this furniture and remove it from an off ice to allow carpeting or other flooring to be replaced. Accordingly, apparatus has been designed and used which will allow the panels and associated furniture to be temporarily raised so that new flooring can be placed underneath. Apparatus of this kind is described, for example, in:

U.S. Pat. No. 5,261,643, issued Nov. 16, 1993 to Wurdack;

U.S. Pat. No. 5,299,779, issued Apr. 5, 1994 to Collins;

U.S. Pat. No. 5,385,335, issued Jan. 31, 1995 to Wurdack;

U.S. Pat. No. 5,490,757, issued Feb. 13, 1996 to Stratman;

U.S. Pat. No. 5,529,287, issued Jun. 25, 1996 to Pelosi, Jr. et al.; and

U.S. Pat. No. 5,628,610, issued May 13, 1997 to Stratman et al.

Several of these patents use lifting jigs which have plates with a series of hooks for engaging the hanging tracks of the panels; for example the Wurdack patents, and those of Stratman and Pelosi et al. have this feature. Applicants have found that the arrangements shown in these patents tend to lack the desired stability, since they positively engage only a relatively short length of the hanging track, typically 2 to 5 inches of the hanging track. Another drawback of these arrangements is that in some makes of panel the hanging tracks may be dislocated if the panels and attached furniture are lifted in this way.

Another shortcoming of the patented arrangements is that it is difficult or impossible to place carpeting underneath the leg of a panel, since this is usually where the lifting device is positioned. Some installers simply accommodate the panel leg and/or the lifting device by cutting out a portion of the carpet or carpet tile, or slitting this around the leg. In the Wurdack '335 patent, there is apparatus, shown in FIGS. 7–9, which provides a lifting device having splayed apart legs which can be placed at opposite sides of a panel leg, and which might allow a relatively small carpet tile to be placed under the panel leg if two joints between tiles happened to be located between the splayed apart legs. However this does not meet the problem of covering a whole floor; since the legs of this lifting apparatus cannot be moved once the furniture is lifted, there are still likely to be areas not accessible for reflooring. Also, it is often be difficult to predict precisely where a carpet tile is to be situated, and the splayed legs allow no room for adjustment. It will be evident from the drawings that in order for the hook 40 to fit into apertures 11 it is considerably narrower than the shaft 14.

The present invention firstly provides apparatus for lifting or supporting modular furniture which is fixed in stable manner to panels, and which holds these panels more stably than prior art apparatus. Secondly, it provides apparatus which allows relatively large carpet tiles, for example 3 foot square tiles, to be positioned under a panel leg and in its vicinity, and allows for changing the relationship between the panel legs and the temporary supporting feet of the apparatus even after a panel has been lifted.

SUMMARY OF THE INVENTION

In accordance with one aspect of the invention, apparatus for lifting or supporting modular furniture to allow access to a floor, where the furniture includes panels with accessory hanging tracks, has a support with a shaft which normally extends vertically, and a lifting jig which is movable vertically on the shaft by jacking means, the lifting jig comprising:

a lower portion having a support plate suitable for engaging the underside of a panel adjacent to a leg; and an upper, stabilizer portion spaced above said support plate and having an undercut hook suitable for engagement with one of the hanging tracks so as to positively locate the jig in relation to the panel.

To provide good stability, the hook is prefer ably at least 8 or 9 inches above the support plate and preferably more than 11 inches above this plate. The spacing of the hook and the support plate is adjustable to allow the hook and plate to grip a portion of the panel between them, giving a positive hold on the panel. The lateral position of the hook may also be adjustable relative to the plate.

The shaft preferably includes a rack having ratchet type teeth, and the lifting jig has a pawl which engages the rack and allows lifting of the jig, while preventing lowering of the jig until the pawl is disengaged from the rack. The jacking means may be removable and usable with other lifting devices spaced around the same or other panels; accordingly the basic apparatus of this invention may be merely a supporting device for use with a variety of jacking means. The jacking means may also have a pawl type member which grips the rack, and the lifting jig may have a downwardly facing abutment surface suitable for being lifted by the jacking means.

To allow for flexibility in the placing of flooring such as carpet tiles in proximity to panel legs, the apparatus, in addition to the support and lifting jig, may further comprise a bridge member having spaced feet and a normally horizontally extending bar, and a carrier or saddle member slidable horizontally on the bar and carrying an auxiliary support for the lifting jig. With this arrangement, the invention may also include the method of using jacking means to raise the lifting jig up the shaft to lift a panel, removing the jacking means, and positioning the bridge member with carrier and auxiliary support so that the latter may support the lifting jig, after which the shaft is removed to provide clear working space under the bridge member and between its feet. Positioning of the bridge member, and of auxiliary support on the bridge member, can be deferred until the precise position for insertion of a carpet tile has been determined, and until areas which are to be used to support the bridge member feet have been refloored. The auxiliary support preferably has its own jacking means to allow gradual transfer of the load to the auxiliary support.

In an other arrangement which also allows replacing of flooring under a panel leg, the basic support itself includes a bridge member having spaced feet and a normally horizontally extending bar, and a carrier slidable horizontally on the bar, this carrier holding the lower end of the normally vertical shaft of the lifting apparatus. The bridge member allows the shaft to occupy a wide variation of positions above a clear working space under the bridge member and between its feet; this clear working space is preferably more than 3 feet in width.

BRIEF DESCRIPTION OF THE DRAWINGS

Preferred embodiments of the invention will now be described by way of example with reference to the accompanying drawings, in which.

DETAILED DESCRIPTION

Figure 1:
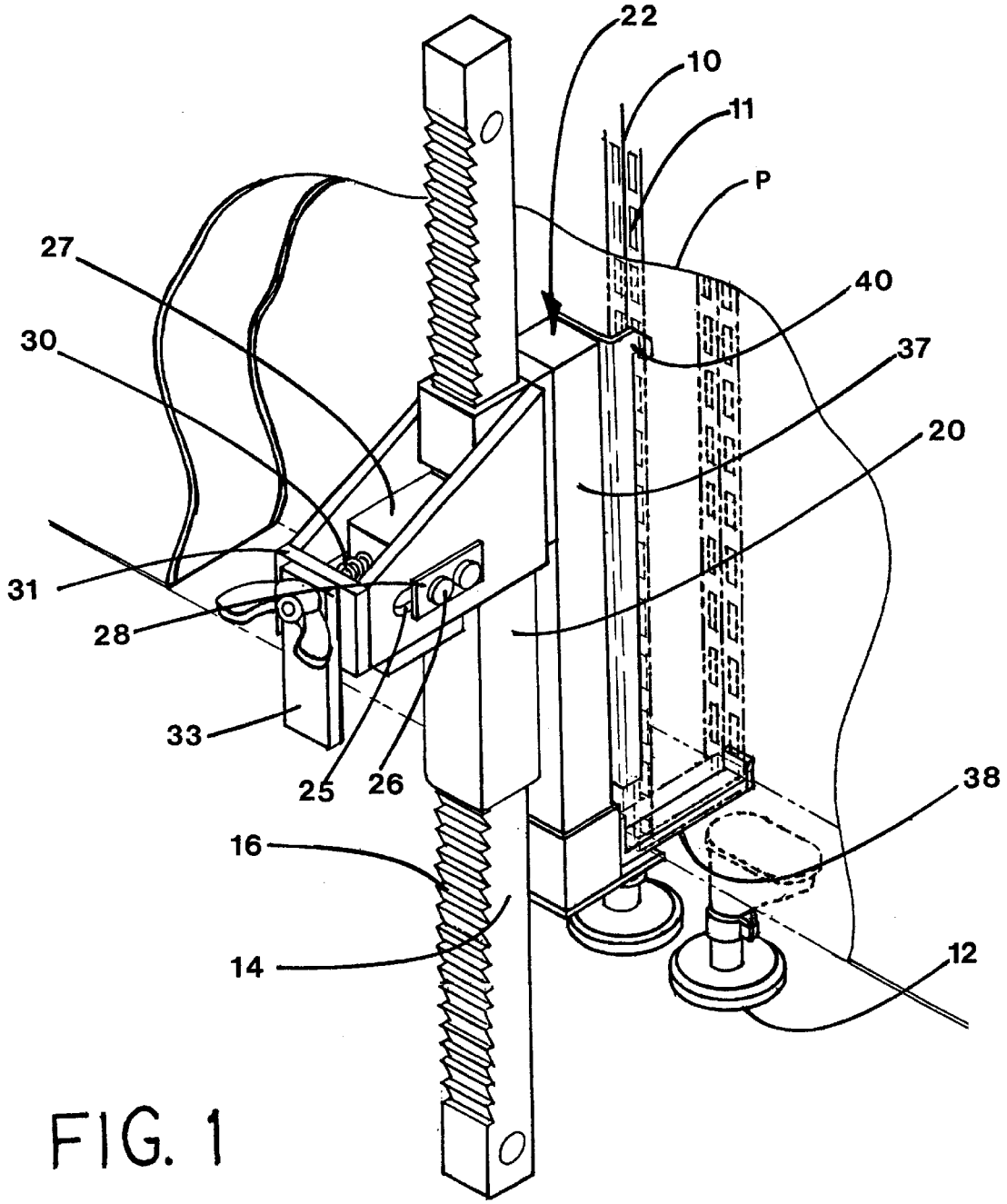
FIG. 1 is a perspective view of lifting apparatus in accordance with the invention, shown supporting a panel.

Referring to FIG. 1, this shows apparatus of the invention being used to lift and support part of a panel P having a hanging track 10 with elongated apertures 11, and having a leg 12 approximately aligned with the hanging track. As will be explained below, this apparatus is one of a series used around a plurality of connected panels. The lifting apparatus has a support including a shaft 14 which normally extends vertically, and which has a square section. The side of the shaft opposite the panel, hereinafter referred to as the rear side, is provided with a rack 16 of ratchet type teeth having substantially horizontal upper surfaces.

Figure 2:
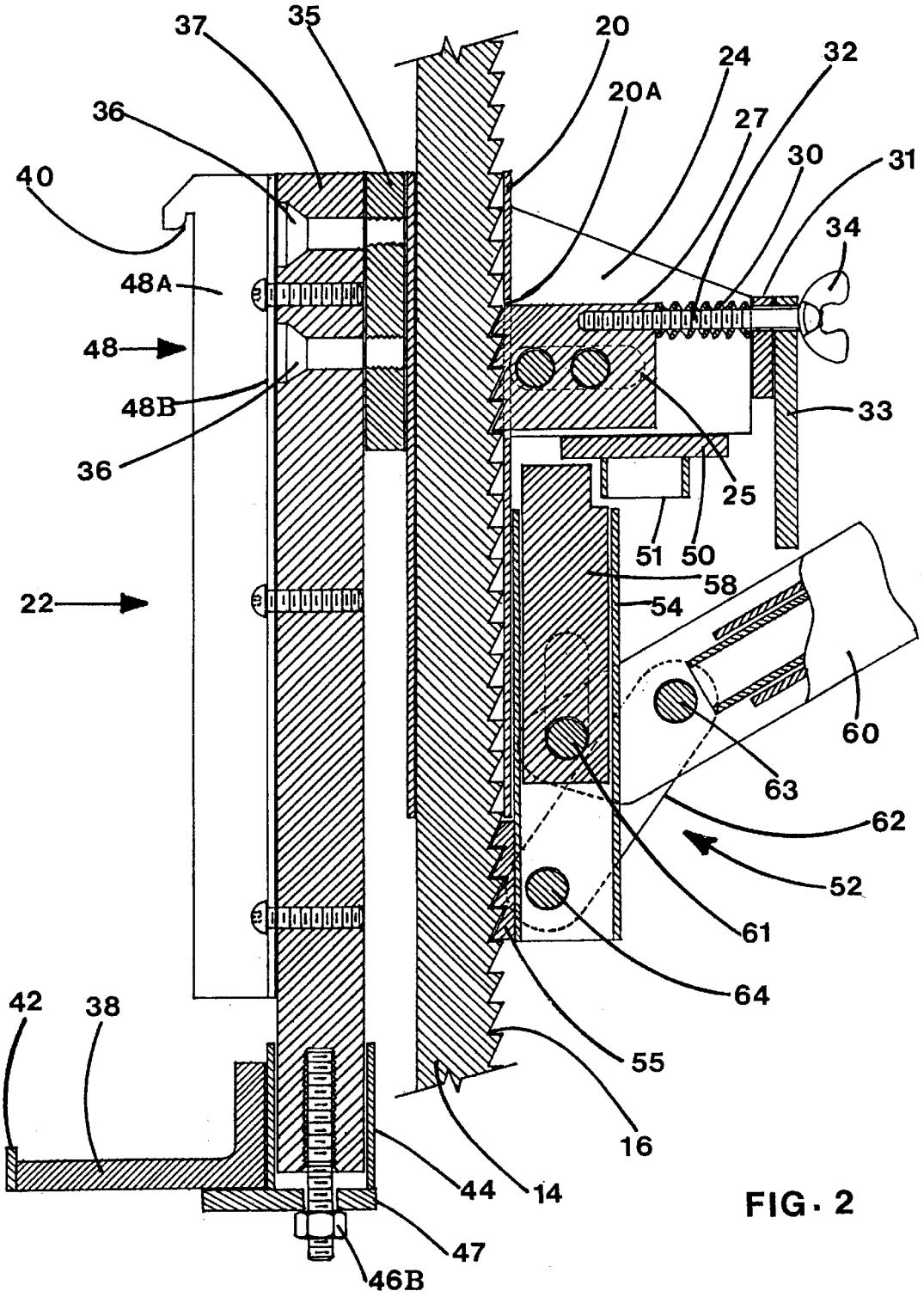
FIG. 2 is a sectional elevation of the main parts of the lifting apparatus of FIG. 1.

Slidable on the shaft 14 is a square-sectioned sleeve 20 which closely surrounds the shaft and which is part of a lifting jig 22. Walls in the form of brackets 24 extending rearwardly from opposite sides of the sleeve 20 have horizontally elongated slots 25 which provide guides for the ends of a pair of slidable horizontal pins 26 which support a pawl 27 located between the walls 24. The outer ends of the pins 26 are connected together outside the walls 24 by spacer plates 28. The pawl 27 is movable within an aperture 20*a* in the rear of the sleeve 20, and has a series of teeth which, as best seen in FIG. 2, are complementary to those of the rack 16 and are caused to engage those teeth by the action of compression spring 30 acting between the rear of the pawl 27 and a back wall 31 joining the rear ends of the walls. The pawl 27 is movable to release the rack by a rod 32 threaded into the pawl and passing along the center of the spring 30 and through apertures in wall 31 in a pawl retracting lever 33, and which terminates in a pawl retracting wing screw 34. The lever 33 can be manually pivoted away from the wall 31 to pull the rod 32 against the force of the spring 30 so to release the pawl from the rack 16.

Figure 3B:
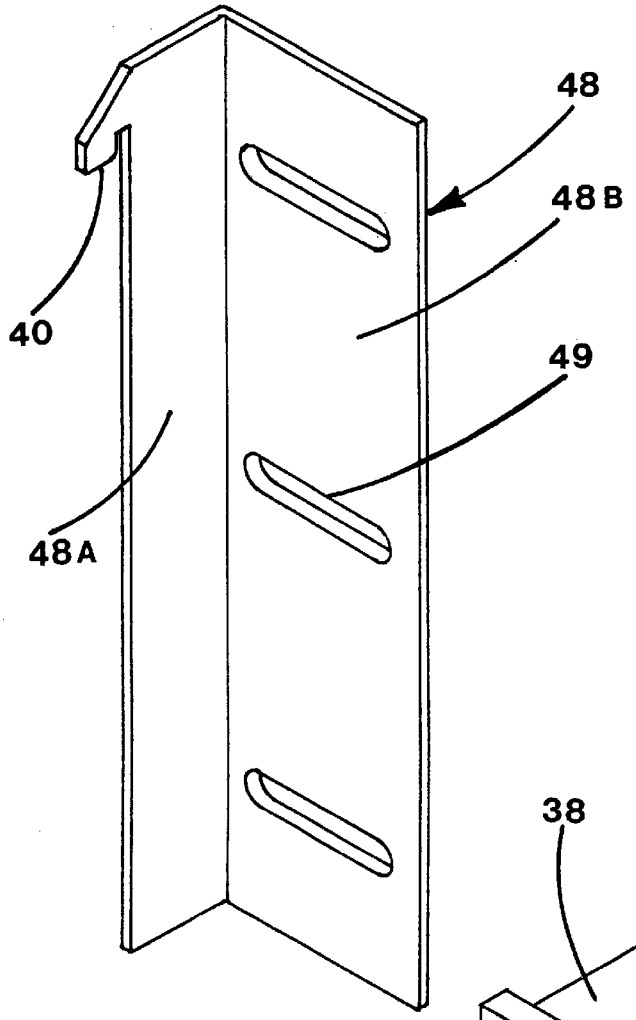
FIGS. 3*a* and 3*b* are perspective views of parts of the lifting apparatus.
Figure 3A:
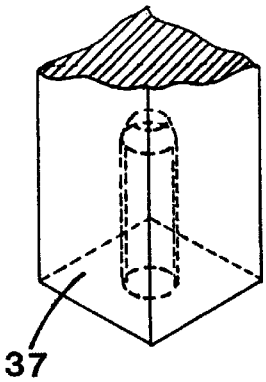
Figure 3A:
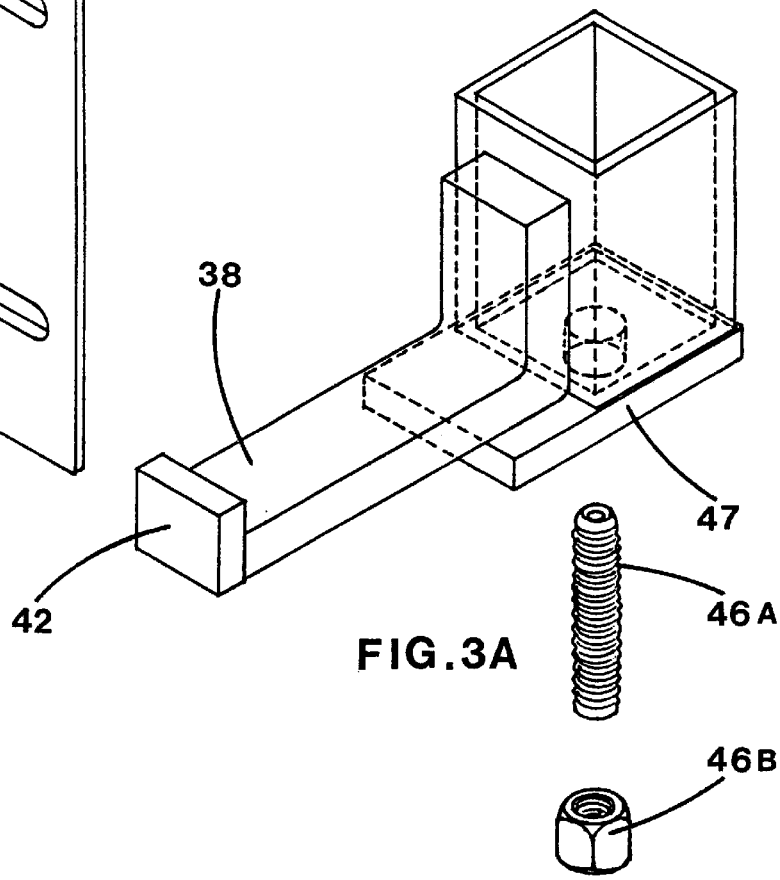

The front side of the sleeve 20 carries a spacer mounting plate 35 to which is attached, by screws 36, a square sectioned main bracket support 37 which carries the panel engaging parts of the lifting jig 22. These parts include a boot support plate 38, shown in detail in FIG. 3*a*, and an undercut hook member 40 shown in detail in FIG. 3*b*. The plate 38 has an outer upturned retaining lip 42, and is carried by a boot sleeve 44 having an upwardly open recess fitting onto the lower end of the main bracket support 37. The boot sleeve is adjustably held in place by a screw stud 46*a* and nut 46*b*, the screw stud fitting into a threaded bore in the bottom end of support 37. A boot brace plate 47 underlies and reinforces the connection between the plate 38 and the boot sleeve 44. The hook 40 is formed in a projecting flange 48*a* of a plate member 48 which also has a right-angled flange 48*b* which lies against the front side of the support 37 and which has three laterally elongated slots 49 which receive screws attaching the plate member to the support 37. These slots allow adjustment of the lateral position of the hook 40 relative to the support plate 38. As shown, the undercut hook 40 provides a downwardly facing recess which is capable of engaging on the lower edge of a panel aperture 11, while the support plate 38 engages the lower edge of the same panel, as shown in FIG. 1. The nut 46*b* allows the plate 38 to be raised so that the panel is positively gripped between the hook recess and the plate. The spacing between the hook and the plate is at least 8 or 9 inches, preferably slightly more than 11 inches, so that the panel is stably held relative to the lifting jig.

As seen in FIG. 2, the lifting jig also includes an abutment or support plate 50, held by the lower edges of the walls 24, from which projects a short cylindrical tube 51 which provides a jack piston retainer for the movable part or "piston" of removable jacking means 52, as shown in FIG. 2; it can also be used to locate the piston of a hydraulic jack described below. The jacking means has a lower, relatively fixed, piston casing 54 the sides of which are supported by a toothed pawl or gripper block 55 capable of engaging on the rack 16 below the sleeve 20. The piston casing slidably holds a piston 58 movable relative to the casing by a jack handle 60. The handle is connected to the lower end of the piston 58 by a cross pin 61 which is movable in vertically elongated slots in the sides of the casing, and the handle 60 also has connection to the casing provided by side links 62 which extend between a holding cross pin 63 near the handle lower end and a similar pin 64 fixed across the lower end of the casing and which also holds the gripper block 55 in the casing. With this arrangement, downwards movement of the handle pushes up the piston 58 and thus raises the whole jig and panel part carried thereby by an amount equivalent to several teeth of the rack 16.

In operation, the jig is firstly attached to the panel as shown, with the nut 46*a* being adjusted to bring the plate 38 up so that a portion of the hanging track 10 of the panel is firmly held between the plate and the hook portion 40. The shaft 14 is then inserted into the sleeve 20. A series of similar lifting devices are situated all around a number of connected panels, to allow the panels and the attached fittings to be lifted evenly. Jacking means such as shown at 52 are then used successively around the lifting devices to lift the panels to the desired height. To avoid strain on the panels, each device is lifted a little at a time, with the jacking means being moved around between the strokes, so that the furniture is maintained reasonably level. Carpeting, usually in the form of carpet tiles, can then be placed under the panels, so far as this is possible without conflicting with the positions of the bottom end of shaft 14.

Figure 4:
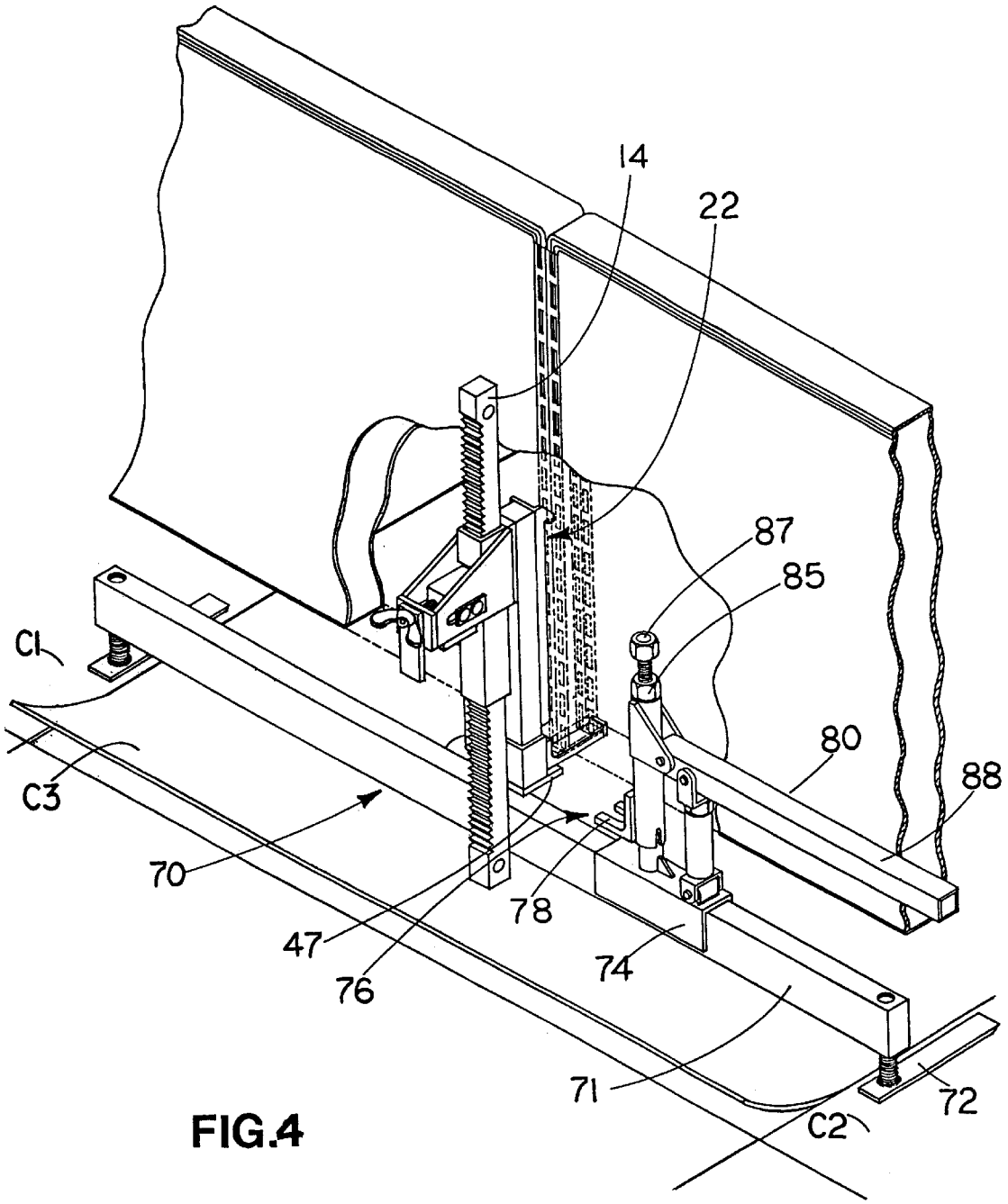
FIG. 4 is a perspective view of the apparatus of FIG. 1 in association with a bridge member and associated parts which allow carpeting to be placed under a panel leg.

FIG. 4 shows additional apparatus which may be used where carpet tiles such as $C_1$, $C_2$, have been laid in the vicinity of a lifting device, which will usually also be the vicinity of a panel leg, and where it is desired to replace a tile $C_3$ in the position occupied by the lifting device.

As shown, the additional apparatus includes a bridge member 70, the bridge 71 of which comprises a straight length of rectangular tubing or solid bar stock supported by spaced apart feet 72 which are adjustable in height and hold the bridge 71 several inches above the floor. The bridge 71 is preferably long enough that the feet 72 can be spaced far enough apart to provide a clear working space of more than 3 feet between the legs. On this bridge is slidable a carrier 74 of saddle form, i.e. with depending sides which contact the sides of the bridge and hold it upright, and which carries an auxiliary support 76. The support 76 includes a load angle bracket 78 which can fit under the boot brace plate 47 to support the lifting jig, and also includes auxiliary jacking means 80 for raising this bracket.

Figure 5:
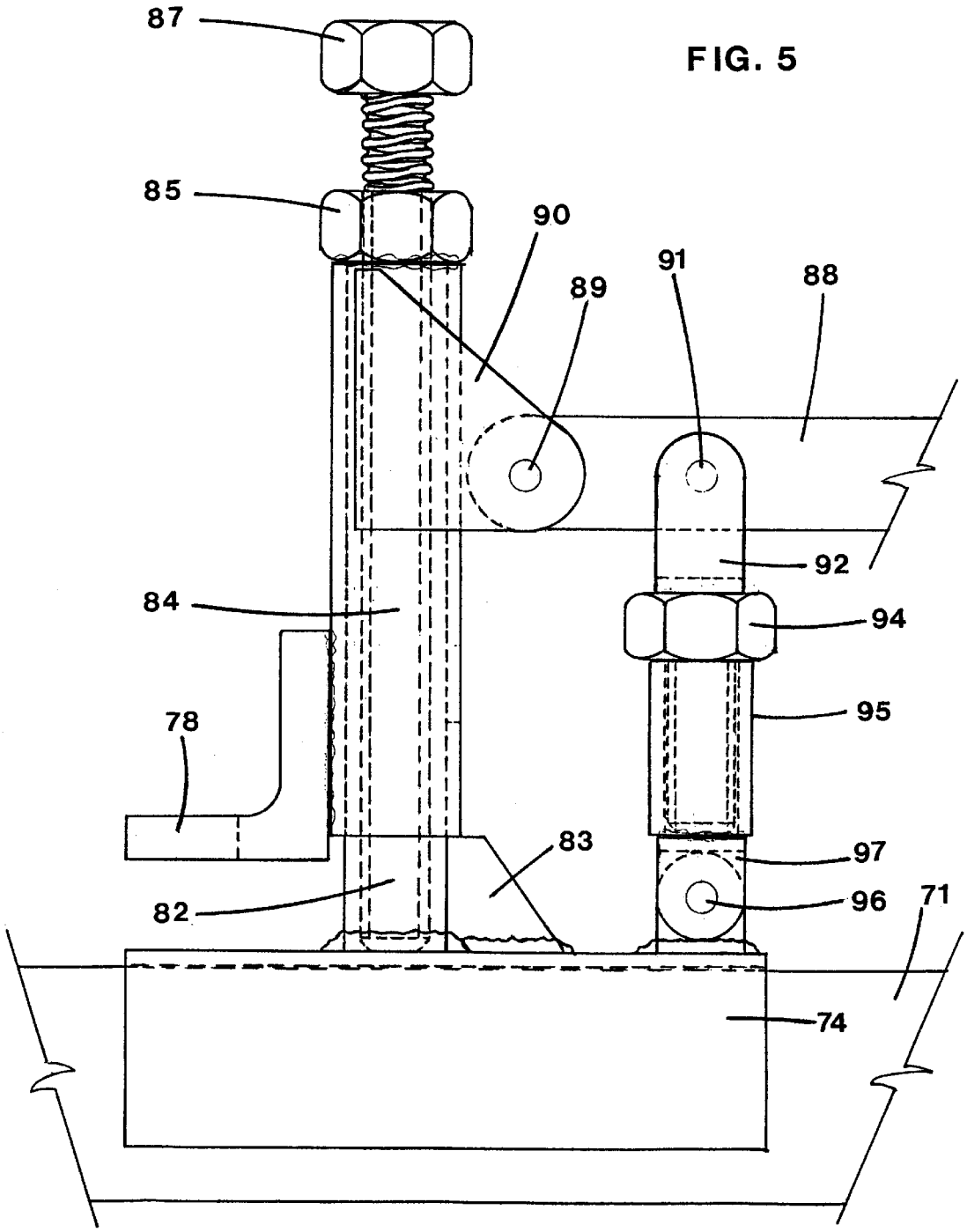
FIG. 5 is an enlarged view of a jacking device used with the apparatus of FIG. 4.

The auxiliary jacking means, best seen in FIG. 5, includes a tubular sleeve post 82 braced by a gusset 83 to the carrier 74, on which post is slidable an actuator cylinder 84 which carries the load angle bracket 78, and which has nut 85 welded to its upper end. This nut receives a height adjustment screw 87 which extends down through the sleeve post to engage the carrier at its lower end. The cylinder 84, along with screw 87, can be raised by a lever 88 which has its inner end pivoted at 89 to lever holding plates 90 welded to the sides of the actuator cylinder, and which has a fulcrum provided by a pivot pin 91 held by the top of a pivot bracket 92. The lower end portion of the bracket 92 is screw threaded and engages an adjustment nut 94 held by a pivot sleeve 95 which receives the main threaded part of the bracket 92, and which is connected to the carrier 74 by pivot pin 96 and fixed pivot bracket 97.

In operation, the bridge member is positioned as shown with its legs clear of the carpet tile $C_3$ which is to be replaced. The carrier 74 is positioned with its bracket 78 under the boot brace plate 47, and the auxiliary jacking means is used to transfer the weight of the panel from the shaft 14 to the bridge member. This involves firstly raising the actuator cylinder 84 by rotation of the screw 87 until the bracket 78 is in contact with the boot brace plate, and then pushing down lever 88 to raise the bracket 78 until this is taking the full load of the panel. When the bridge is taking the full load, screw 87 is tightened so that its lower end again engages the bottom of the sleeve post 82 so as to hold the bracket 78 in position, after which the handle 88 is released. The shaft 14 and its foot 13 can then be removed to allow replacement of the tile $C_3$.

Figure 6:
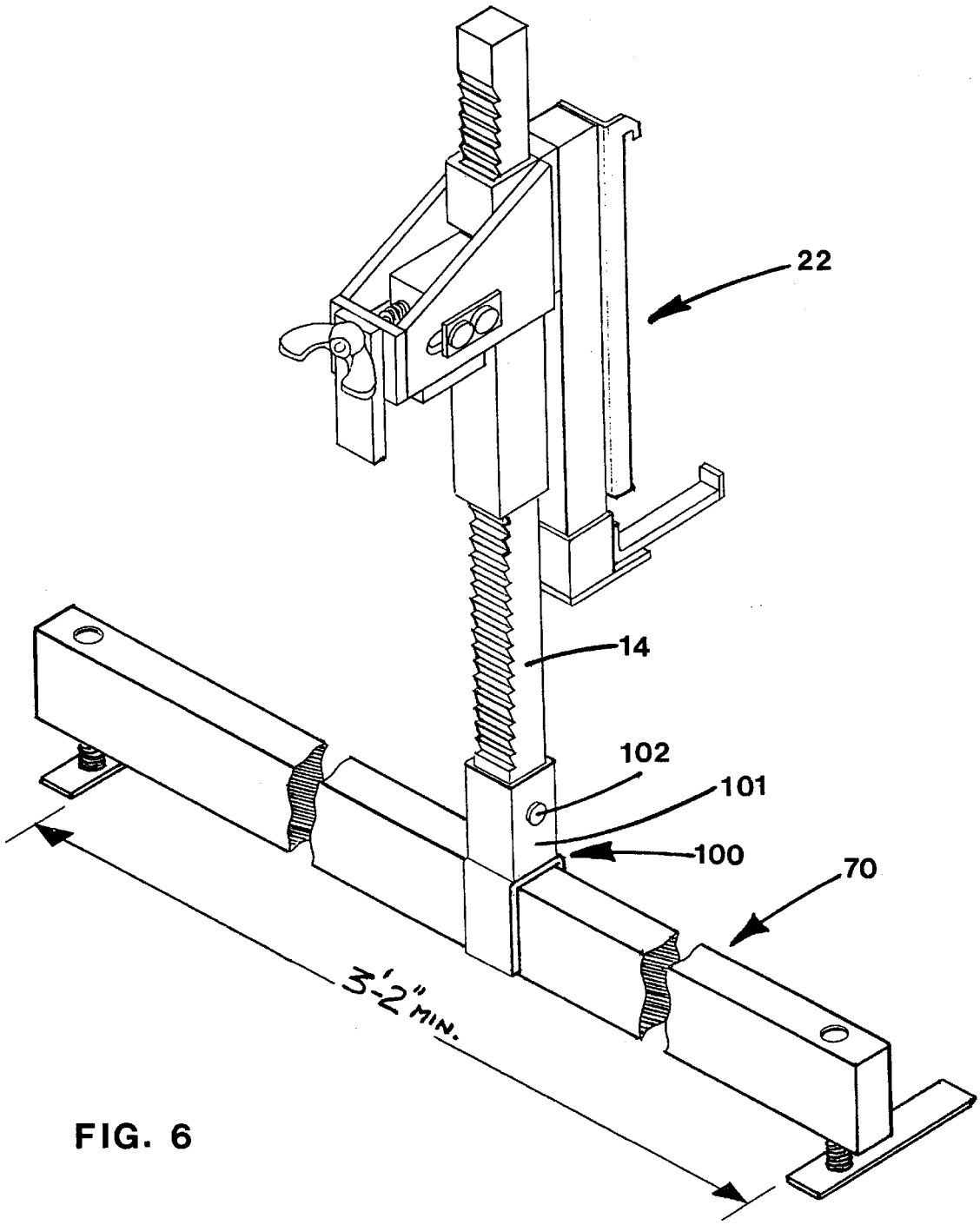
FIG. 6 is a perspective view of an alternative apparatus, including a bridge member, which may also be used for fitting carpeting under the leg of a panel.

FIG. 6 shows apparatus which can be used to lift a panel at a location near to a panel leg while leaving a clear space under the leg. Here the lifting jig 22 of FIGS. 1 and 2 is carried by a vertical shaft 14' mounted directly on a saddle member 100 supported by a bridge member 70' similar to that previously described. The saddle member 100 supports the shaft 14' by means of a vertically oriented socket 101 which receives a cross pin 102 holding the shaft. One use of this arrangement is in removal and replacement of a panel of raised flooring, typically 2 feet square, of the type which is used in certain types of offices where electrical ducts are accommodated under such a raised floor. The use of the bridge member allows the flooring panel to be placed under the location of a panel leg at a position which can be adjusted by movement of the saddle along the bridge, prior to lifting, so that the bridge legs are clear of the flooring panel. This adjustability is absent from the splayed leg arrangement of the Wurdack '335 patent referred to above.

Most of the components described above are preferably made of steel. However to save the weight which needs to be carried by workers, some of the larger components, including the shaft 14, the support 37, and the bridge 71, are preferably made of aluminum.

Figure 7:
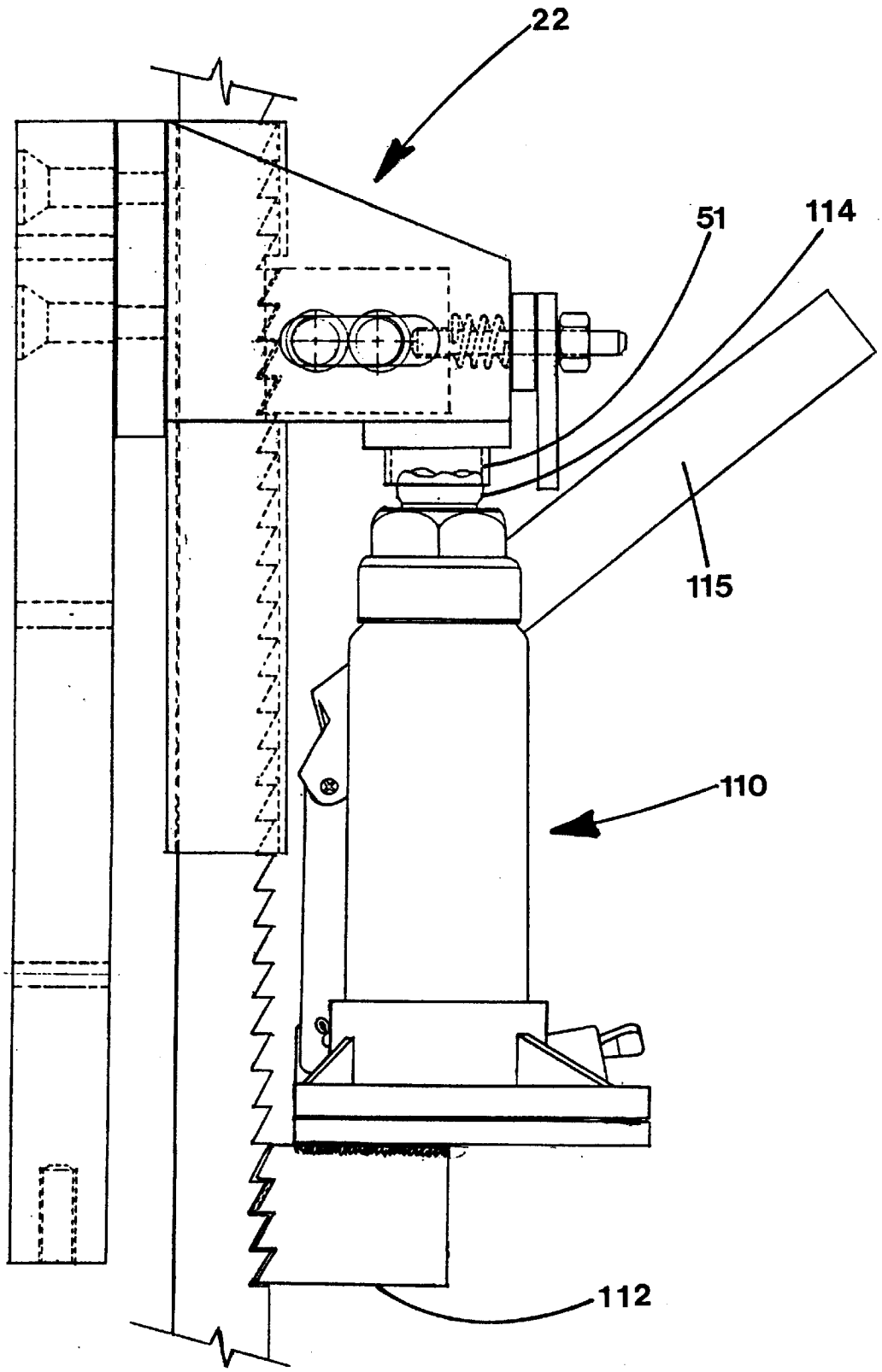
FIG. 7 is a side view of main parts of the lifting jig when being used with hydraulic jacking means.

While purely mechanical jacking means have been described, a hydraulic jack of generally known form may also be used, modified by being provided with a suitable gripper block for engaging the rack. A jack 110 of this kind is shown in FIG. 7. As shown, this has a gripper block 112 attached to its base, for gripping the rack 16, and has the upper end of its piston received in the piston retainer tube 51. The jack is operated by handle 115 to raise the lifting jig 22.

We claim:

1. Apparatus for lifting or supporting modular furniture, the furniture including panels having accessory hanging tracks with apertures, the apparatus including a support having a shaft which normally extends vertically, and a lifting jig which is movable vertically on the shaft by jacking means, wherein the lifting jig surrounds the shaft and comprises:

a lower portion having a support plate suitable for engaging the underside of a panel; and an upper, stabilizer portion spaced above said support plate and having an undercut hook which is considerably narrower than the shaft and suitable for engagement within one of the apertures of said hanging tracks so as to positively locate the jig in relation to the panels;

and wherein said hook has a downwardly facing undercut recess for engaging the bottom of one of said hanging track apertures, and wherein the spacing between the hook and support plate is adjustable to allow the hook to enter an aperture at one spacing and for the panel to be positively gripped between the hook and the support plate at another spacing.

2. Apparatus according to claim 1, wherein said hook is adjustable in lateral position relative to said support plate.

3. Apparatus according to claim 1, wherein said hook is formed in a protecting flange of a plate member which also has a flange at a right angle to said projecting flange and which is adjustable in lateral position relative to said support plate.

4. Apparatus according to claim 1, wherein said shaft includes a ratchet type rack, and wherein said lifting jig includes a sleeve surrounding the rack and has a toothed pawl which engages said rack and which allows lifting of the jig, and prevents lowering of the jig until the pawl is disengaged from the rack, said jig also having a downwards facing surface suitable for being supported by a removable jacking device.

5. Apparatus according to claim 1, wherein the support includes a bridge member having a normally horizontal bridge extending between spaced feet, and wherein a lower end of said shaft is supported by a carrier slidable horizontally on said bridge, whereby the support allows the shaft to occupy a wide variation of horizontally displaced positions above a clear working space under the bridge member and between said feet.

6. Apparatus according to claim 1, further comprising a bridge member having a normally horizontal bridge extending between spaced feet, and a carrier slidable horizontally on said bridge and carrying an auxiliary support for said lifting jig, whereby when the jacking means has lifted the panel by movement of the lifting jig on the shaft, the bridge member and carrier and auxiliary support may be positioned and used to support the lifting jig, while the shaft is removed to provide clear working space under the bridge member and between said feet.

7. Apparatus according to claim 6, wherein the auxiliary support includes auxiliary jacking means for raising said auxiliary support, and also includes an adjustment screw for holding the auxiliary support in a position into which it is raised by said auxiliary jacking means.

* * * * *